United States Patent [19]

Dunnick

[11] Patent Number: 4,663,896

[45] Date of Patent: May 12, 1987

[54] WINDOW FRAME MEMBERS

[75] Inventor: Julian S. Dunnick, York, Pa.

[73] Assignee: Capitol Products Corporation, Mechanicsburg, Pa.

[21] Appl. No.: 870,935

[22] Filed: Jun. 5, 1986

Related U.S. Application Data

[63] Continuation of Ser. No. 727,115, Apr. 25, 1985, abandoned.

[51] Int. Cl.[4] ..... E04B 1/346

[52] U.S. Cl. ..... 52/71; 52/475; 52/201

[58] Field of Search ..... 52/71, 475, 276, 277, 52/201, 207, 397, 399, 731, 732

[56] References Cited

U.S. PATENT DOCUMENTS

| | | | |
|---|---|---|---|
| 2,642,018 | 6/1953 | Weeber | 52/277 |
| 3,210,808 | 10/1965 | Creager | 52/475 |
| 3,389,527 | 6/1968 | Collard | 52/731 |
| 4,009,546 | 3/1977 | Buck, Jr. | 52/201 |

*Primary Examiner*—William F. Pate, III
*Assistant Examiner*—Creighton Smith
*Attorney, Agent, or Firm*—Donald L. Johnson; John F. Sieberth; Paul H. Leonard

[57] ABSTRACT

An interlocking mullion or window jamb of variable or adjustable angularity for use in bow or bay windows. The construction can be used with metal, plastic or wood windows.

8 Claims, 2 Drawing Figures

WINDOW FRAME MEMBERS

This application is a continuation of application Ser. No. 727,115 filed Apr. 25, 1985, now abandoned.

BACKGROUND OF THE INVENTION

The present invention relates to window frame members or wall opening frame members. The invention particularly relates to frame members or mullions for bow windows or bay windows.

In the construction of buildings, it is often desirable to have a wall opening with a bay window or a bowed window construction of a particular angle. Normally, when a certain angle is desired in mulling two or more window units together, a separate mullion is required to provide each individual or specific angular construction.

The present invention provides an interlocking or hinged window mullion or window jamb of variable or adjustable angularity for use in constructing bay windows or bow windows of any desired angle.

The framing members of this invention are especially suited for use with existing metal or aluminum windows. The frame members can also be used with wood windows or plastic or vinyl windows.

SUMMARY OF THE INVENTION

The invention is a window jamb or mullion construction comprising two basic shapes or extruded members interlocked or hingedly connected together on one side and variably slidably joined together on the opposite side to form a box-like frame or hollow frame construction which can be attached to separate window units or other framing members so as to join together such separate units or framing members at a desired angle.

DESCRIPTION OF THE PREFERRED EMBODIMENTS

Figure 1:
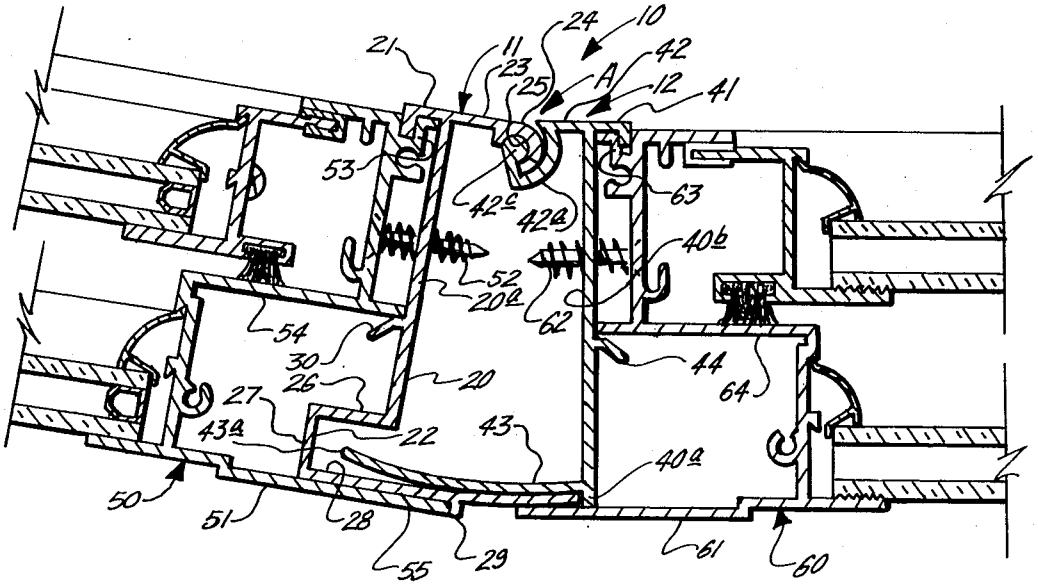
FIG. 1 is a cross-sectional view of the window frame members of the invention shown joining two separate window frame members; and, FIG. 2 is a view of the frame member of FIG. 1 illustrating the pivoting relationship of the individual frame members to each other.

Referring to the drawings and particularly to FIG. 1, the window jamb or mullion of the invention is indicated generally at 10. The mullion 10 comprises two basic shapes or aluminum extrusions, an exterior mull 11 and an interior mull 12. The mulls are preferably extruded aluminum shapes which are cut to a desired length, depending upon the height or vertical length of the window units to be joined together. They may also be constructed of plastic or even steel, if desired. The window units joined together by the mulls are preferably made of aluminum, but may also be constructed of other metal, plastics or even wood.

The exterior mull or female frame member 11 comprises a central or main member 20 which has an outwardly extending L-shaped flange 21 on the interior end thereof and an outwardly extending U-shaped channel 22 on the exterior end thereof. Also on the interior end of the member 20 and extending inwardly therefrom opposite the flange 21 is hinge member 23. The member 23 has a curved or somewhat C-shaped end 24 having an arcuate channel 25 therein.

Channel member 22 comprises outwardly extending short leg or member 26, joining member 27 and inwardly extending long leg or member 28. The outer end **28*a* of the leg 28 is somewhat curved or bowed inwardly. A short flange or stop member 29 extends perpendicularly and outwardly from the long leg 28** and about the center thereof.

A short angular flange 30 extends outwardly from the central member 20 at a somewhat center portion thereof and toward the channel member 22.

The interior mull 12 comprises central or main member 40 which has an outwardly extending L-shaped flange 41 on the interior end thereof, a hinging member 42 extending inwardly from the interior end of mull 12 and opposite flange 41, and an elongated arcuate flange or bowed member 43 extending inwardly from near the exterior end of the member 12. An end portion **40*a* of the member 40 forms a stop for inhibiting the movement of the leg 28** as will be explained more fully hereinafter.

The hinging member 42 has a curved or somewhat arcuate-shaped member **42*a* extending downwardly from the end thereof. A flange 42*b* extends perpendicularly from the end of the arcuate member 42*a*. The flange 42*b* has an enlarged end 42*c* adapted to be received by channel 25. The member 42*a* is also adapted to receive the curved end 24 of hinge member 23**.

A short angular flange 44 extends outwardly from the central member 40 at a somewhat center portion thereof and somewhat toward stop member **40*a***.

Exterior mull 11 is slidably longitudinally engaged with interior mull 12, whereby hinge member 23 and hinging member 42 are slidably longitudinally engaged with each other to form hinge A. Bowed or curved flange 43 is adapted to frictionally engage long leg 28 and extend into the channel 22 of member 20.

Figure 2:
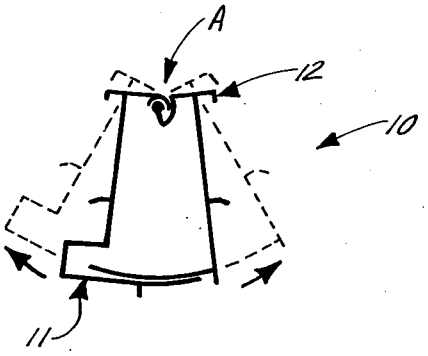

When the two frame members 11 and 12 are slidably joined together, they may be pivoted around hinge A so as to be "opened" or "closed" as illustrated in FIG. 2. The end **43*a* of the curved member 43 is stopped by the member 27 and/or the stop member 40*a* makes contact with the end 28*b* of the member 28 to stop pivoting movement around the hinge A whereby the outer portions of the mulls 11 and 12 are moved toward each other or "closed". The members 11 and 12 may also be pivoted around hinge A so that their outer parts are moved away from each other. Movement is such that the members 28 and 43 are frictionally engaged. The placement of a weather sealing compound on the outer side of the member 43 and/or the inner side of the member 28** effectively seals the two members to each other once they are placed in their permanent position.

Once slidably assembled against each other, the hingedly joined together frame members 11 and 12, as joined together in the manner of FIG. 1, can only be disassembled or disconnected by slidably moving the members in opposite directions, i.e. longitudinally changing the position or relationship of one of the members to the position or relationship of the other member. In effect, the two members are disengaged from each other in the same manner in which they are engaged to each other. The connected members 11 and 12 cannot be separated latitudinally.

As illustrated in FIG. 1, the jamb 10 is shown as it is attached to a standard dual pane thermal window. Window 50 is attached to frame member 11 and window 60 is attached to frame member 12. Frame member 11 is adapted to be engaged with an attached to frame member or jamb 51 and frame member 12 is adapted to be engaged with and attached to frame member or jamb 61. Member 11 is attached to member 51 by screw 52 or any other suitable means. Member 12 is attached to member 61 by screw 62. Additional screws or fasteners are utilized as necessary to affix one frame member to another.

Jamb 51 has a flahge 53 on the interior end thereof for receiving and interlocking with flange 21 of the mull 11. Jamb 61 has a flange 63 on the interior end thereof for receiving and interlocking with flange 41 of the mull 12.

The longitudinal edge of central member 54 of jamb 51 is adjacent one side of main member 20. Stop 30 and flange 21 along with the section 20*a* of member 20 provides a channel for receiving flange 53 and member 54.

Central member 64 of jamb 61 is adjacent one side of main member 40. Stop 44 and flange 41 along with section 40*b* of member 40 provide a channel for receiving flange 63 and member 64.

Stop member 29 provides a limit for the movement of facing member 55 of jamb 51.

Windows 50 and 60 are regular commercial dual pane windows. It can be readily appreciated that jambs 51 and 61, which in the instant case are substantially identical may be constructed and/or extruded in a variety of shapes. Mullion 10 is constructed to fit or conform with the window construction illustrated. It can be appreciated however, that variations may be made in the particular cross-section construction or extrusion of the jamb members 51 and 61.

The mullion 10 may be "closed" to provide a 180° angle or may be "opened" to provide a 90° angle between window 50 and window 60. Generally, a bow construction of something between 180° and 90° is preferred.

For simplicity of illustration, only the expandable and/or interlocking mullion construction is shown. Headers and Sills may be constructed in the normal manner. Window construction may be single glazed as well as dual-glazed or multi-glazed.

The bay or bow windows of this invention may be prefabricated or assembled on the job-site. The unique construction may have extremely close tolerances or may provide for assembly when tolerances are not as accurate or close as would normally be desired.

Mullions 11 and 12 are preferably individual aluminum extrusions which are cut and sized to a desired length. Five or six feet is common for most window constructions. Other size windows, e.g. two, three or four feet, are also possible.

A wide variety of constructions are also possible. Windows may be single glazed, double glazed or even multi-glazed. Windows may also be single panelled or multi-panelled. The flexibility of the present invention is unique in that the particular type window construction is almost limitless. A bay or bow window can be quickly and easily constructed from three regular windows. The windows may be readily attached to each other by the novel hinged mullion.

As illustrated, the windows 50 and 60 are substantially identical. The windows joined may also be different from each other as desired. A mullion 10 may also be used to join window 62 with another window to form the other side of a bay or bow window.

The mullion 10 of the present invention is preferably constructed of a pair of aluminum extrusions or shapes. Plastic, steel, other metals or even wood may also be used. The particular materials from which the mullions are constructed should of course be construction quality, i.e. particularly suited for the construction intended. The mullion 10 can be used to join windows of aluminum, other metals, plastic and/or wood.

It can readily be appreciated that variations in the particular extruded shape of jamb 51 and 61 may be made without departing from the scope of invention.

Applications Serial No. 727,116 and 727,145, each entitled "Frame Member for Bow Windows or the Like", and filed even date herewith illustrate specific embodiments of the frame members comprising the mullion of this application. These applications are specifically incorporated herein.

The foregoing disclosure and description of the invention is illustrative and explanatory thereof and various changes in the illustrated construction may be made with the scope of the appended claims without departing from the spirit of the invention.

What is claimed is:

1. A window jamb or mullion for constructing bow or bay windows comprising two longitudinal frame members longitudinally slidably joined together and constructed so as to be hingedly joined together on one side thereof and variably slidably joined together on the opposite side thereof to form a boxlike or hollow frame construction for attachment to a window unit on each side of said mullion, said longitudinally slidably joined together longitudinal frame members being only longitudinally slidably disconnectable from each other, and each of said longitudinal frame members having means thereon for adjacently engaging a frame member of a window unit, and said hingedly connected longitudinal frame members being so constructed that a window unit attached to one side of said mullion may be positioned at any angle from about 90° to about 180° from a window unit attached to the other side of said mullion, said two longitudinal frame members comprising an arcuate member on one edge of one longitudinal frame member for variably slidably engaging a channel means on one edge of the other longitudinal frame member and channel means on one edge of said other longitudinal frame member for variably slidably receiving said arcuate means.

2. The window jamb or mullion of claim 1, wherein said longitudinal frame members are extruded aluminum shapes.

3. The window jamb or mullion of claim 1, wherein said longitudinal frame members are constructed of metal, plastic or wood.

4. The window jamb or mullion of claim 1, including an attachment means for securing each of said longitudinal frame members to a frame member of a window unit.

5. A window jamb or mullion for joining together a window unit on each side thereof comprising two longitudinal frame members longitudinally slidably joined together and constructed so as to be hingedly joined together on one side thereof and variably slidably joined together on the opposite side thereof, a hinge means extending longitudinally on one edge the length thereof of one longitudinally frame member for longitudinally slidably and hingedly receiving a receiving hinge means on one edge of the other longitudinal frame member, a receiving hinge means extending longitudinally on one edge the length thereof of said other longitudinal frame member for longitudinally slidably and hingedly receiving said hinge means on said one longitudinal frame member, arcuate means on one edge of said one longitudinal frame member opposite said hinge means for variably slidably engaging a channel means on one edge of said other longitudinal frame member opposite said receiving hinge means, channel means on one edge of said other longitudinal frame member opposite said receiving hinge means for variably slidably engaging said arcuate means on said one edge of said one longitudinal frame member, said longitudinally slidably joined together longitudinal frame members being only slidably disconnectable from each other, thereby providing when said longitudinal frame members are longitudinally slidably joined together an expandable hollow mullion for joining together a window unit on each side thereof, and said longitudinal frame members being variably positionable from each other whereby a window unit attached to one longitudinal frame member may be at any angle of about 90° to about 180° from a window unit attached to the other longitudinal frame member.

6. The window jamb or mullion of claim 5, including attachment means for securing each of said longitudinal frame members to the frame member of a window unit engaged thereon.

7. The window jamb or mullion of claim 5, wherein each of said longitudinal frame members is an extruded aluminum shape.

8. The window jamb or mullion of claim 5, wherein said longitudinal frame members are constructed of metal, plastic or wood.

* * * * *

UNITED STATES PATENT AND TRADEMARK OFFICE

CERTIFICATE OF CORRECTION

PATENT NO. : 4,663,896

DATED : MAY 12, 1987

INVENTOR(S) : Julian S. Dunnick

It is certified that error appears in the above-identified patent and that said Letters Patent is hereby corrected as shown below:

Column 3, line 7 reads "flahge" and should read -- flange --.

Column 4, line 37 reads "member" and should read -- means --.

Signed and Sealed this

Fifteenth Day of September, 1987

*Attest:*

DONALD J. QUIGG

*Attesting Officer*

*Commissioner of Patents and Trademarks*